US006393841B1

(12) United States Patent
Van Husen

(10) Patent No.: US 6,393,841 B1
(45) Date of Patent: May 28, 2002

(54) INTERNAL COMBUSTION ENGINE WITH DUAL EXHAUST EXPANSION CYLINDERS

(76) Inventor: Norman Robert Van Husen, 31961 Kathryn St., Garden City, MI (US) 48135

( * ) Notice: Subject to any disclaimer, the term of this patent is extended or adjusted under 35 U.S.C. 154(b) by 0 days.

(21) Appl. No.: 09/893,063

(22) Filed: Jun. 28, 2001

(51) Int. Cl.[7] ..... F02G 3/00
(52) U.S. Cl. ..... 60/620; 123/51 R; 123/52.1
(58) Field of Search ..... 60/620; 123/51 R, 123/51 A, 52.1, 58.1

(56) References Cited

U.S. PATENT DOCUMENTS 1,358,954 A * 11/1920 Holmstrom ..... 123/51 R
2,196,228 A * 4/1940 Prescott
4,237,832 A * 12/1980 Hartig et al. ..... 123/59 EC
4,955,328 A * 9/1990 Sobotowski ..... 123/51 R
5,056,471 A * 10/1991 Van Husen ..... 123/51 R

* cited by examiner

*Primary Examiner*—Hoang Nguyen

(57) ABSTRACT

An Internal combustion engine is provided having separately designated combustion and exhaust powered cylinders, for implementing a dual exhaust expansion system which derives additional power from the combustion exhaust gases of each cylinder. The piston in each combustion exhaust cylinder is timed such that one leads the other by approximately 0–180 degrees crankshaft angle. Ignition of a first combustible air/fuel mixture produces combustion gases. Expansion of the combustion gases drives the first combustion piston during a first power stroke. Combustion gases are expelled from the cylinder to a second cylinder via fluidic passage to produce a second power stroke in the second cylinder, from there the combustion gasses are exhausted to atmosphere. Ignition of a second combustible air/fuel mixture produces combustion gases. Expansion of the combustion gases drives the second combustion piston during a third power stroke. Combustion gases are expelled from the second cylinder to the first cylinder via fluidic passage to produce a fourth power stroke in the first cylinder from there the combustion gases are exhausted to atmosphere in a predetermined cycle.

15 Claims, 4 Drawing Sheets

| FIRST CYLINDER 12 | | | | | | | | |
|---|---|---|---|---|---|---|---|---|
| CRANK 16 REV./DEG. | | | VALVE 42 | VALVE 38 | VALVE 36 | VALVE 30 | VALVE 26 | PISTON 14 STROKE |
| REV.1 | 2A | 180° | X | | | | | FIRST INTAKE |
| | 2B | 360° | | | | | | FIRST COMPRESSION |
| REV.2 | 2C | 180° | | | | | | FIRST POWER |
| | 2D | 360° | | X | | X | | FIRST EXHAUST |
| REV.3 | 2E | 180° | X | | | | | SECOND INTAKE |
| | 2F | 360° | | | | | | SECOND COMPRESSION |
| REV.4 | 2G | 180° | | | | | | SECOND POWER |
| | 2H | 360° | | X | X | | | SECOND EXHAUST |
| REV.5 | 2J | 180° | | X | | X | | FIRST INTAKE POWER |
| | 2K | 360° | | X | X | | | THIRD EXHAUST |
| SECOND CYLINDER 18 | | | | | | | | |
| CRANK 16 REV./DEG. | | | VALVE 42 | VALVE 38 | VALVE 36 | VALVE 30 | VALVE 26 | PISTON 20 STROKE |
| REV.1 | 2L | 180° | | | | | | THIRD COMPRESSION |
| | 2M | 360° | | | | | | THIRD POWER |
| REV.2 | 2N | 180° | | | X | X | | FOURTH EXHAUST |
| | 2P | 360° | | X | | X | | SECOND INTAKE POWER |
| REV.3 | 2Q | 180° | | | X | X | | FIFTH EXHAUST |
| | 2R | 360° | | | | | X | THIRD INTAKE |
| REV.4 | 2S | 180° | | | | | | FOURTH COMPRESSION |
| | 2T | 360° | | | | | | FOURTH POWER |
| REV.5 | 2U | 180° | | X | | X | | SIXTH EXHAUST |
| | 2V | 360° | | | | | X | FOURTH INTAKE |

FIG.2

X VALVE OPEN

FIG.4

[X] VALVE OPEN

| FIRST CYLINDER 120 | | | | | | | |
|---|---|---|---|---|---|---|---|
| CRANK 160 REV./DEG. | | | PORT 380 | VALVE 320 | VALVE 340 | VALVE 260 | PISTON 140 STROKE |
| REV. 1 | 4A | 30° | X | | | | FIRST INTAKE AND COMPRESSION |
| | 4B | 150° | | | | | |
| | 4C | 330° | | | | | FIRST POWER AND EXHAUST |
| | 4D | 360° | X | | X | X | |
| REV. 2 | 4E | 30° | X | | X | X | FIRST INTAKE AND EXHAUST |
| | 4F | 150° | | | X | X | |
| | 4G | 330° | | X | X | | FIRST INTAKE |
| | 4H | 360° | X | X | X | | |
| REV. 3 | 4J | 30° | X | | | | SECOND INTAKE AND COMPRESSION |
| | 4K | 150° | | | | | |
| | 4L | 330° | | | X | X | FIRST INTAKE POWER AND EXHAUST |
| | 4M | 360° | X | X | X | X | |
| SECOND CYLINDER 180 | | | | | | | |
| CRANK 160 REV./DEG. | | | PORT 380 | VALVE 320 | VALVE 340 | VALVE 260 | PISTON 200 STROKE |
| REV. 1 | 4N | 150° | | X | | X | SECOND INTAKE |
| | 4P | 180° | X | X | | X | |
| | 4Q | 210° | X | | | | THIRD INTAKE AND COMPRESSION |
| | 4R | 360° | | | | | |
| REV. 2 | 4S | 150° | | | X | X | SECOND INTAKE POWER AND EXHAUST |
| | 4T | 180° | X | X | X | X | |
| | 4U | 210° | X | | | | FOURTH INTAKE AND COMPRESSION |
| | 4V | 360° | | | | | |
| REV. 3 | 4W | 150° | | | | | SECOND POWER AND EXHAUST |
| | 4X | 180° | X | | X | X | |
| | 4Y | 210° | X | | X | X | SECOND INTAKE AND EXHAUST |
| | 4Z | 360° | | | X | X | |

INTERNAL COMBUSTION ENGINE WITH DUAL EXHAUST EXPANSION CYLINDERS

BACKGROUND OF THE INVENTION

Field of the Invention

The Applicant is the owner and inventor of U.S. Pat. No. 5,056,471 the present invention generally relates to internal combustion engines having reciprocating pistons. More specifically this invention relates to an Internal Combustion Engine having designated combustion exhaust cylinders, through which a double expansion system is implemented for deriving work from the combustion exhaust gases of the combustion cylinders. Description of Prior Art Internal combustion (IC) engines currently are by far The predominant engine form used today for purposes of providing power to propel motorized vehicles, as well as many other forms of transportation and recreation devices.

The (IC) engine is preferred, for it's exceptional power and weight ratio and energy storage potential (miles traveled between refueling), when compared to other comparable forms of automotive power. However, concern for the environment and preservation of natural resources has continuously encouraged efforts to improve the efficiency, performance and fuel economy of (IC) engines while reducing their noxious emissions and noise. Several arrangements have been suggested to improve (IC) engine efficiency by providing intercooperating cylinders having different functions. Included in other prior arts known to me are eleven inventions which pertain to internal combustion engines having reciprocating pistons some what related to the engine of the present invention but which differ therefrom in operation and/or structure to a considerable degree. One example of this approach is shown in U.S. Pat. No. 2,196,228 to Prescott. Prescott discloses pairs of high pressure and low pressure cylinders in which an air/fuel mixture is combusted in the primary high pressure cylinder and exhausted to a low pressure cylinder to raise thermal efficiency. No air/fuel mixture is combusted in the low-pressure cylinder to produce additional power.

Another example of this approach is shown in U.S. Pat. No. 4,237,832 to Hartig. Hartig discloses a Partial load control apparatus and method for internal combustion engines. Where with decreasing load, high-pressure combustion cylinders are changed over to low pressure after expansion cylinders, No additional work is provided to the engine from the high-pressure cylinders from incompletely expanded combustion gases of low-pressure cylinders.

Another example of this approach is shown in foreign patent No.128921 to Shimizu. Shimizu discloses a pair of cylinders in which an air/fuel mixture is combusted in the first cylinder and exhausted to a second cylinder, which provides additional power to the crankshaft of the internal combustion engine in a two-stroke cycle. No air/fuel mixture is combusted in the second cylinder to produce additional power to the crankshaft.

The advantage to this arrangement is providing additional power to the crankshaft of the IC engine without burning additional fuel. The disadvantage is no additional power is delivered to the second cylinder without the combustion of additional fuel as compared to a comparably sized IC engine.

SUMMARY OF THE INVENTION

According to the present invention there is provided an IC engine having at least two cylinders, generally referred to as a first cylinder and a second cylinder, respectively, which reciprocally reside within their respective cylinders. The first and second pistons are reciprocated by any conventional means, such as an engine crankshaft, between top dead center (TDC), where they are furthest from the crankshaft axis, and bottom dead center (BDC) at which time they are at their nearest point to the crankshaft axis. The second piston is timed by the crankshaft. Leading the first piston by a predetermined crankshaft angle such that the second piston is retreating from TCD when the first piston is retreating from BDC. The first cylinder has a first cylinder intake port and a first cylinder exhaust port. A fluidic passageway connects the exhaust port of the first cylinder with the exhaust port of the second cylinder.

The first cylinder intake port is open by the first cylinder intake valve, during the intake stroke of the first cylinder. But is otherwise closed during the first cylinder's compression stroke, first cylinder's power stroke, first cylinder's exhaust stroke and first cylinder's intake power stroke.

The first cylinder also has a first cylinder exhaust port, which is open by the first cylinder exhaust valve, during the first cylinder's exhaust strokes. But otherwise closed during the first cylinder's intake stroke, first cylinder's compression stroke, first cylinder's power stroke first cylinder's intake power stroke.

The first cylinder is also in communication with a third exhaust port, which is opened by a third exhaust valve. The third exhaust valve is open During the first cylinder's exhaust stroke to atmosphere, but otherwise closed during the transfer of exhaust gases from one cylinder to the other during the intake power stroke of the first cylinder.

A second cylinder is also provided with a second cylinder intake port and a second cylinder exhaust port. The second cylinder intake port is open by the second cylinder intake valve during the intake stroke of the second cylinder's piston. But is otherwise closed during the second cylinder's compression stroke, second cylinder's power stroke, second cylinder's exhaust stroke, second cylinder's intake power stroke.

The second cylinder also has a second cylinder exhaust port, which is open by the second cylinder exhaust valve during the second cylinders exhaust strokes. But is otherwise closed during the second cylinder's intake stroke, second cylinder's compression stroke, second cylinder's power stroke and second cylinder's intake power stroke.

The second cylinder is also in communication with a third exhaust port, which is opened by a third exhaust valve. The third exhaust valve is open, During the second cylinder's exhaust strokes to atmosphere, but otherwise closed during the transfer of exhaust gases from one cylinder to the other during the intake power stroke of the second cylinder. A fluidic passage is provided between the first cylinder exhaust port, the second cylinder exhaust port and the third exhaust port for purposes to be explained later.

In operation of the IC engine, a combustible air/fuel mixture is drawn into the first cylinder through the first cylinder's intake valve during the intake stroke of the first cylinder's piston. The combustible fuel mixture is then compressed within the first cylinder during the first cylinder's compression stroke and is ignited just prior to TDC at the end of the first cylinder's compression stroke.

Ignition is accomplished by any suitable igniter, such as a conventional engine spark plug. Upon ignition, the combustible fuel mixture produces combustion gasses within the first cylinder. The expansion of the combustion gasses drives the first cylinder's piston toward BDC during the first cylinder's power stroke, and the gasses are expelled from the first cylinder during the first cylinder's exhaust stroke. The combustion gasses exit the first cylinder via it's first cylinder exhaust port and flow through the fluidic passage to the second cylinder, entering the second cylinder through the second cylinder exhaust port.

The combustion gasses are received by the second cylinder at the start of the second cylinder's intake power stroke. The timing between the first cylinder's piston and the second cylinder's piston, is such that the combustion gasses exert a force on the second cylinder's piston and drives the second cylinder's piston toward BDC. From there the combustion gasses are expelled from the second cylinder through the second cylinder exhaust port and out to atmosphere through the third exhaust port during the second cylinder's exhaust stroke.

A combustible air/fuel mixture is drawn into the second cylinder through the second cylinder's intake valve during the intake stroke of the second cylinder's piston. The combustible fuel mixture is then compressed within the second cylinder, during the second cylinder's compression stroke and is ignited just prior to TDC at the end of the second cylinder's compression stroke. Ignition is accomplished by any suitable igniter, such as a conventional engine spark plug. Upon ignition, the combustible fuel mixture produces combustion gasses within the second cylinder. The expansion of the combustion gasses drives the second cylinder's piston toward BDC during the second cylinder's power stroke, the gases are expelled from the second cylinder during the second cylinder's exhaust stroke. The combustion gasses exit the second cylinder via it's second cylinder exhaust port and flow through the fluidic passage to the first cylinder, entering the first cylinder through the first cylinder exhaust port. The combustion gasses are received by the first cylinder at the start of the first cylinder's intake power stroke.

The timing between the second cylinder's piston and the first cylinder's piston is such that the combustion gasses exert a force, on the first cylinder's piston and drives the first cylinder's piston toward BDC. From there the combustion gasses are expelled from the first cylinder through the first cylinder exhaust port and out to atmosphere through the third exhaust port during the first cylinder's exhaust stroke.

The timing of the first cylinder and second cylinder is such that the engine receives three power strokes every five revolutions per cylinder. Two conventional four-stroke power strokes and one exhaust power stroke, which will be discussed later with the preferred embodiment and timing diagrams. Overall this preferred embodiment allows each cylinder to alternate between burning fuel to power the piston in each cylinder and using exhaust gases to power the piston in each cylinder in a four-stroke IC engine cycle.

In, contrast, operation of a two-stroke cycle allows the combustion of an air/fuel mixture in each cylinder and is timed such that the engine receives two power strokes every three revolutions per cylinder. One conventional two-stroke power stroke and one exhaust power stroke. This preferred embodiment allows each cylinder to alternate between burning fuel to power the pistons and using exhaust gases to power the pistons. Which will be discussed later with the preferred embodiment and timing diagrams.

According to a preferred aspect of the present invention, an advantageous feature is that the combustion gasses of the first and second cylinder are not merely exhausted to atmosphere, but are directly used to derive additional work from the engine. As a result, the output torque of an IC engine in accordance with the present invention is greater than that of comparably sized IC engine having the same number of cylinders and combusting the same quantity of fuel. Balance of the engine is more stable due to the alternating combustion of fuel in each cylinder over comparable double expansion engines.

In addition, a significant advantage of the present invention is that, by reducing the amount of fuel burning cycles pollutants can be greatly reduced and fuel economy increased in comparison to a conventional IC engine.

It is further object of this invention that such an engine more effectively utilizes the energy potential within the combustion exhaust gasses that would otherwise be lost by exhausting to atmosphere. Other objects and advantages of this invention will be more apparent after reading of the following detailed description taken in conjunction with the drawings provided.

BRIEF DESCRIPTION OF THE DRAWINGS

FIG. 2 is timing diagram representation of the preferred valve timing sequence of schematic view FIG. 1, in accordance with a preferred embodiment of this invention.

FIG. 4 is timing diagram representation of the preferred valve timing sequence of schematic view FIG. 3, in accordance with a preferred embodiment of this invention.

DESCRIPTION OF THE PREFERRED EMBODIMENT

Figure 1:
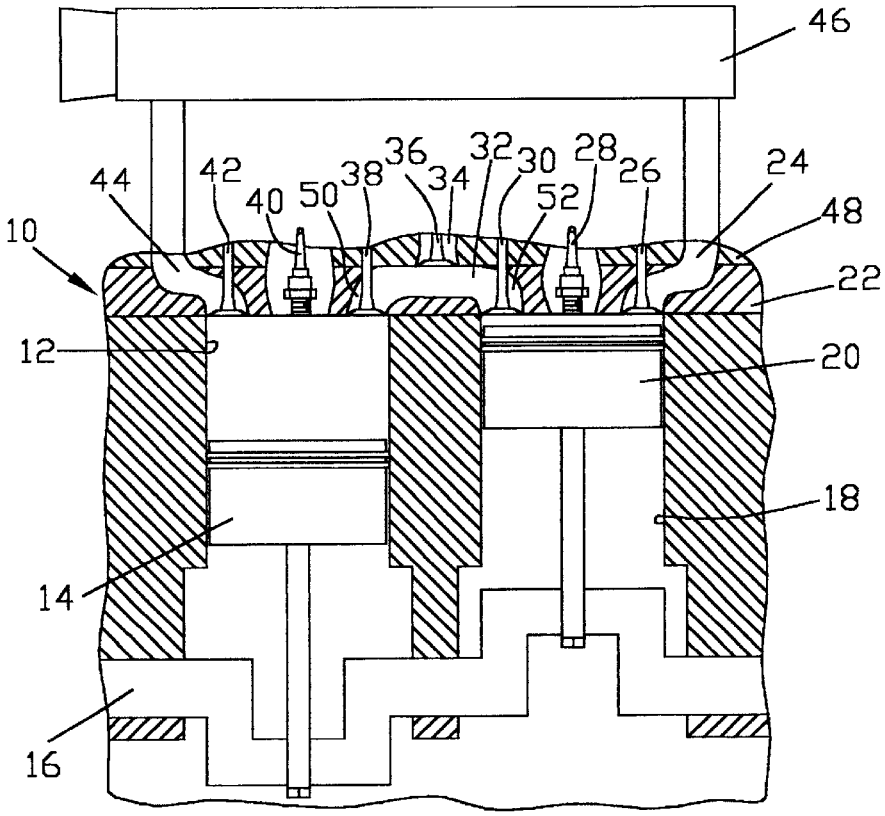
FIG. 1 is a schematic view, partly in cross-section, of a carbureted four-stroke internal combustion engine with spark ignition in accordance with a preferred embodiment of this invention.

In a preferred embodiment of this invention, the internal combustion engine (IC) engine 10 is provided with at least one pair of cylinder pairs, as shown in FIG. 1. The cylinder pairs can be oriented in any manner, such as in-line, opposing, or at some angle therebetween such as in a conventional four-cylinder engines. Each pair consists of a combustion and exhaust-powered cylinder 12 and combustion and exhaust powered cylinder 18.

A cylinder head 22 encloses the upper end of both the combustion exhaust cylinders 12 and 18. A second cylinder head 48 encloses the upper end of fluidic passage 32. The combustion exhaust cylinder 12 and the combustion exhaust cylinder 18 have a combustion exhaust piston 14 and a combustion exhaust piston 20 respectively, which reciprocally reside within their respective cylinders.

Both the combustion exhaust piston 14 and combustion exhaust piston 20 are reciprocated by any conventional means, such as engine crankshaft 16. For purposes of discussion, the preferred embodiment shown in FIG. 1 is a four-stroke spark ignition IC engine. As such, the combustion exhaust piston 14 of FIG. 1 reciprocates successively through two distinguishable strokes during one revolution of crankshaft 16 and five revolutions during one cycle. A first intake stroke, a first compression stroke, a first power stroke, a first exhaust stroke, a second intake stroke, a second compression stroke, a second power stroke, a second exhaust stroke, a first intake power stroke and a third exhaust stroke. The operation of combustion exhaust piston 20 operates identically to the cycle of combustion exhaust piston 14, but leads combustion piston 14 by five strokes, such that as combustion piston 14 is beginning its first intake stroke as combustion exhaust piston 20, is beginning its third compression stroke. The operation of combustion exhaust piston 14, and combustion exhaust piston 20 will be further explained below under the discussion with timing diagram FIG. 2 and timing diagram FIG. 4.

The combustion exhaust cylinder 12 has an intake port 44 and an exhaust port 50, both of which are preferably located in the cylinder head. The intake port 44 and exhaust port 50 are closeable by an intake valve 42 and an exhaust valve 38, respectively. Both intake and exhaust valves 42 and 38 are actuated by any conventional valve cam arrangement (not shown) which is timed to operate in cooperation with the crankshaft 16. An air/fuel mixing device, such as a carburetor 46 as illustrated or in the alternative a fuel injector, is in fluidic communication with the intake valve 42, of the combustion exhaust cylinder 12 for metering the fuel mixture requirements to the combustion exhaust cylinder 12.

The intake valve 42 operates to open the intake port 44 for the intake stroke of the combustion exhaust piston 14 and closes port 44 for the compression, power, exhaust and intake power strokes of the combustion exhaust piston 14. Conventional timing of the intake valve 42 will have the intake port 44 opening at a crankshaft angle of approximately 5 to 15 degrees, prior to the combustion exhaust piston 14 reaching top dead center (TDC) before the beginning of the intake stroke.

The exhaust valve 38 operates to open the exhaust port 50 for the exhaust stroke of the combustion exhaust piston 14 and the intake power stroke of combustion exhaust piston 14, and closes the exhaust port 50 for the intake, compression and power strokes of combustion exhaust piston 14. Conventional timing of the exhaust valve 38 will have the exhaust port 50 opening at a crankshaft angle of approximately 165 to 175 degrees, prior to the combustion exhaust piston 14 reaching bottom dead center (BDC) before the beginning of the exhaust stroke. Opening the exhaust port 50 at a crankshaft angle of approximately 5 to 15 degrees prior to the combustion exhaust piston 14 reaching (TDC) before the beginning of the intake power stroke for purpose of illustration, the preferred embodiment is a spark-ignition engine requiring the combustion cylinder 12 to also be provided with an ignition spark plug 40. The spark plug 40 initiates combustion within the combustion exhaust cylinder 12, typically between a crankshaft angle of approximately 0 to 30 degrees, prior to (TDC) during the compression stroke of the combustion exhaust piston 14.

The combustion exhaust cylinder 18 has an intake port 24 and an exhaust port 52, both of which are preferably located in the cylinder head. The intake port 24 and exhaust port 52 are closeable by an intake valve 26 and an exhaust valve 30, respectively. Both intake and exhaust valves 26 and 30 are actuated by any conventional valve cam arrangement (not shown) which is timed to operate in co-operation with the crankshaft 16. An air/fuel mixing device, such as a carburetor 46 as illustrated or in the alternative a fuel injector, is in fluidic communication with the intake valve 26, of the combustion exhaust cylinder 18 for metering the fuel mixture requirements to the combustion exhaust cylinder 18.

The intake valve 26 operates to open the intake port 24 for the intake stroke of the combustion exhaust piston 20, and closes port 24 for the compression, power, exhaust and intake power strokes of the combustion exhaust piston 20, Conventional timing of the intake valve 26 will have the intake port 24 opening at a crankshaft angle of approximately 5 to 15 degrees prior to the combustion exhaust piston 20 reaching top dead center (TDC) before the beginning of the intake stroke.

The exhaust valve 30 operates to open the exhaust port 52 for the exhaust stroke of the combustion exhaust piston 20 and the intake power stroke of combustion exhaust piston 20, and closes the exhaust port 52 for the intake, compression and power strokes of combustion exhaust piston 20, Conventional timing of the exhaust valve 30 will have the exhaust port 52 opening at a crankshaft angle of approximately 165 to 175 degrees, prior to the combustion exhaust piston 20 reaching bottom dead center (BDC) before the beginning of the exhaust stroke. Opening exhaust port 52 at a crankshaft angle of approximately 5 to 15 degrees, prior to the combustion exhaust piston 20 reaching (TDC) before the beginning of the intake power stroke.

For purpose of illustration, the preferred embodiment is a spark-ignition engine requiring the combustion cylinder 18 to also be provided with an ignition spark plug 28. The spark plug 28 initiates combustion within the combustion exhaust cylinder 18, typically between a crankshaft angle of approximately 0 to 30 degrees, prior to (TDC) during the compression stroke of the combustion exhaust piston 20. Combustion exhaust piston 14 and combustion exhaust piston 20 are timed as such that combustion exhaust piston 14 leads combustion exhaust piston 20 by a crankshaft angle of 30 to 180 degrees. As a result, combustion exhaust piston 14 will be retreating form (BDC) at the same time combustion exhaust piston 20 is retreating (TDC).

A fluidic passage 32 is located between and is in communication with the exhaust port 50 of combustion exhaust cylinder 12 and the exhaust port 52 of combustion exhaust cylinder 18. Fluidic passage 32 also has an exhaust port 34 located in the second cylinder head 48, which is in fluidic communication with exhaust port 50 of combustion exhaust cylinder 12 and exhaust port 52 of combustion exhaust cylinder 18. Exhaust port 34 is closeable by an exhaust valve 36 respectively. Exhaust valve 36 is actuated by any conventional valve cam arrangement (not shown), which is timed to operate in co-operation with exhaust port 50, exhaust port 52 and crankshaft 16. The exhaust valve 36 operates to open the exhaust port 34 for an exhaust stroke of combustion exhaust piston 14 and for an exhaust stroke of combustion exhaust piston 20. Exhaust port 34 is otherwise closed during the intake power stroke of combustion exhaust piston 14, and the intake power stroke of combustion exhaust piston 20. Conventional timing of the exhaust valve 36 will have the exhaust port 34 opening at a crankshaft angle of approximately 165 to 175 degrees, prior to the combustion exhaust piston reaching bottom dead center (BDC) before the beginning of the exhaust stroke.

As will be explained next, this aspect is particularly advantageous in that the combustion exhaust cylinder 18, is capable of receiving the combustion exhaust gasses from the combustion exhaust cylinder 12, during the exhaust stroke of the combustion exhaust piston 14. Combustion exhaust cylinder 12 is capable of receiving the combustion exhaust gasses from the combustion exhaust cylinder 18, during the exhaust stroke of the combustion exhaust piston 20. And both combustion exhaust cylinder 12 and combustion exhaust cylinder 18, are capable of exhausting combustion gasses to atmosphere during other consecutive exhaust strokes, of combustion exhaust piston 14 and combustion exhaust piston 20. In operation of the preferred embodiment FIG. 1, and valve timing diagram FIG. 2, the example illustrated in FIG. 2, is only a representation of valve timing which is adapted for purposes of clarity in practicing the present invention. Those skilled in the art will be readily adept to the teachings of the present invention to engines having a different number of cycles and timing sequences.

A carburetor 46 introduces a first combustible air/fuel mixture to the combustion exhaust cylinder 12 through its intake port 44 by opening valve 42. The first combustible mixture being drawn into the combustion cylinder 12. For approximately 0–180 degrees crankshaft rotation during the first intake stroke (2A) of the combustion exhaust piston 14 during the first revolution of crankshaft 16.

The first combustible mixture is subsequently compressed within the combustion exhaust cylinder 12, for approximately 180–360 degrees crankshaft rotation during the first compression stroke (2B) of combustion exhaust piston 14 during the first revolution of crankshaft 16.

As noted above just prior to combustion exhaust piston 14 reaching TDC. The spark plug 40 ignites the first combustible mixture, driving combustion exhaust piston 14 toward BDC. For approximately 0–180 degrees crankshaft rotation during the first power stroke (2C) of the combustion exhaust piston 14 during the second revolution of crankshaft 16.

Near the end of the first power stroke exhaust port 50 is opened by exhaust valve 38. The combustion gasses exit through port 50 into fluidic passage 32 for approximately 180–360 degrees crankshaft rotation during the first exhaust stroke (2D) of the combustion exhaust piston 14 during the second revolution of crankshaft 16. Exhaust gases are received by combustion cylinder 18 through exhaust port 52 at the start of the second intake power stroke (2P) of combustion exhaust piston 20 to produce usable work from the incompletely expanded exhaust gases of combustion exhaust cylinder 12. From there the exhaust gases are exhausted to atmosphere from combustion exhaust cylinder 18 through exhaust port 34 during the fifth exhaust stroke (2Q) of combustion exhaust piston 20.

Carburetor 46 introduces a second combustible air/fuel mixture to the combustion exhaust cylinder 12 through its intake port 44 by opening valve 42. The second combustible mixture being drawn into the combustion cylinder 12, for approximately 0–180 degrees crankshaft rotation during the second intake stroke (2E) of the combustion exhaust piston 14 during the third revolution of crankshaft 16. The second combustible mixture is subsequently compressed within the combustion exhaust cylinder 12 for approximately 180–360 degrees crankshaft rotation during the second compression stroke (2F) of the combustion exhaust piston 14 during the third revolution of crankshaft 16.

Just prior to exhaust piston 14 is reaching TDC, the spark plug 40 ignites the second combustible mixture, driving combustion exhaust piston 14 toward BDC, for approximately 0–180 degrees crankshaft rotation during the second power stroke (2G) of the combustion exhaust piston 14 during the fourth revolution of crankshaft 16.

Near the end of the second power stroke exhaust port 50 is opened by exhaust valve 38. The combustion gasses exit through port 50 into fluidic passage 32. Spent gasses are exhausted to atmosphere through exhaust port 34, by the opening of exhaust valve 36, for approximately 180–360 degrees crankshaft rotation. During the second exhaust stroke (2H) of combustion exhaust piston 14 during the fourth revolution of crankshaft 16.

As combustion exhaust piston 20 begins to move away from BDC during the sixth exhaust stroke (2U) of combustion exhaust piston 20. Exhaust port 50 and exhaust port 52 is opened by exhaust valve 38 and exhaust valve 30. Combustion gasses are received by combustion exhaust cylinder 12 through fluidic passage 32. Piston 14 is forced down by the expanding exhaust gasses from combustion exhaust cylinder 18, for approximately 0–180 degrees crankshaft rotation, during the first intake power stroke (2J) of the combustion exhaust piston 14, during the fifth revolution of crankshaft 16.

Near the end of the first intake power stroke exhaust port 50 remains open by exhaust valve 38. The combustion gasses exit through port 50 into fluidic passage 32. Spent gasses are exhausted to atmosphere through exhaust port 34, by the opening of exhaust valve 36, for approximately 180–360 degrees crankshaft rotation during the third exhaust stroke (2K) of combustion exhaust piston 14 during the fifth revolution of crankshaft 16, which completes one cycle of combustion exhaust cylinder 12.

Combustion exhaust cylinder 18 also cycles through five revolutions of crankshaft 16, the same as combustion cylinder 12 by the aforementioned 30 to 180 degree crankshaft angle lead and timed such that during the first intake stroke (2A) of combustion exhaust cylinder 12, combustion exhaust cylinder 18 is beginning a third compression stroke (2L). A fourth combustible mixture is subsequently compressed within the combustion exhaust cylinder 18, for approximately 0–180 degrees crankshaft rotation during the third compression stroke (2L) of combustion exhaust piston 20 during the first revolution of crankshaft 16. Just prior to combustion exhaust piston 20 is reaching TDC. The spark plug 28 ignites the fourth combustible mixture, driving combustion exhaust piston 20 toward BDC. For approximately 180–360 degrees crankshaft rotation during the third power stroke (2M) of the combustion exhaust piston 20 during the first revolution of crankshaft 16.

Near the end of the third power stroke exhaust port 52 is opened by exhaust valve 30. The combustion gasses exit through port 52 into fluidic passage 32. Spent gasses are exhausted to atmosphere through exhaust port 34, by the opening of exhaust valve 36, for approximately 0–180 degrees crankshaft rotation during the fourth exhaust stroke (2N) of the combustion exhaust piston 20 during the second revolution of crankshaft 16.

As combustion exhaust piston 14 begins to move away from BDC during the first exhaust stroke (2D). Exhaust port 52 and exhaust port 50 are opened by exhaust valve 30 and valve 38. Combustion gasses are received by combustion exhaust cylinder 18 through fluidic passage 32. Piston 20 is forced down by the expanding exhaust gasses from combustion exhaust cylinder 12, for approximately 180–360 degrees crankshaft rotation during the second intake power stroke (2P) of the combustion exhaust piston 20 during the second revolution of crankshaft 16.

Combustion exhaust piston 20 begins a fifth exhaust stroke, through exhaust port 52 into fluidic passage 32. The spent gasses are exhausted to atmosphere through exhaust port 34, by the opening of exhaust valve 36, for approximately 0–180 degrees crankshaft rotation during the fifth exhaust stroke (2Q) of combustion exhaust piston 20 during the third revolution of crankshaft 16.

Carburetor 46 introduces a third combustible air/fuel mixture to the combustion exhaust cylinder 18 through its intake port 24 by opening valve 26. The third combustible mixture is drawn into the combustion cylinder 18. For approximately 180–360 degrees crankshaft rotation during the third intake stroke (2R) of the combustion exhaust piston 20 during the third revolution of crankshaft 16. The third combustible mixture is subsequently compressed within the combustion exhaust cylinder 18, for approximately 0–180 degrees crankshaft rotation during the fourth compression stroke (2S) of combustion exhaust piston 20 during the fourth revolution of crankshaft 16.

Just prior to combustion exhaust piston 20 reaching TDC. The spark plug 28 ignites the third combustible mixture, driving combustion exhaust piston 20 toward BDC. For approximately 180–360 degrees crankshaft rotation during the fourth power stroke (2T) of the combustion exhaust piston 20 during the fourth revolution of crankshaft 16. Near the end of the first power stroke exhaust port 52 is opened by exhaust valve 30.

The combustion gasses exit through port 52 into fluidic passage 32 for approximately 0–180 degrees crankshaft rotation during the sixth exhaust stroke (2U) of the combustion exhaust piston 20. During the fifth revolution of crankshaft 16, combustion gases are received by combustion cylinder 12 through exhaust port 50 at the start of the first intake power stroke (2J) of combustion exhaust piston 14 to produce usable work from the incompletely expanded exhaust gasses of combustion exhaust cylinder 18. From there the exhaust gases are exhausted to atmosphere through exhaust port 34 during the third exhaust stroke (2K) of combustion exhaust piston 14.

Carburetor 46 introduces a fourth combustible air/fuel mixture to the combustion exhaust cylinder 18 through its intake port 24 by opening valve 26. The fourth combustible mixture being drawn into the combustion cylinder 18. For approximately 180–360 degrees crankshaft rotation during the fourth intake stroke (2V) of the combustion exhaust piston 20 during the fifth revolution of crankshaft 16, which completes the overall cycle of combustion exhaust cylinder 18 and combustion exhaust piston 14 from here the above mentioned cycle repeats.

Though the IC engine 10 of FIG. 1 is discussed in terms of a four-stroke engine with spark ignition, the teachings of the present invention are not limited as such, and can be successfully employed with other reciprocating piston engines such as two stroke and diesel engines. The operation of a four-stroke diesel engine incorporates the present invention and is nearly identical to the above description except that the air/fuel mixture is provided by fuel injection means, such as a conventional fuel injector. The air/fuel mixture is auto-ignited, eliminating the need for a spark-ignition device.

Figure 3:
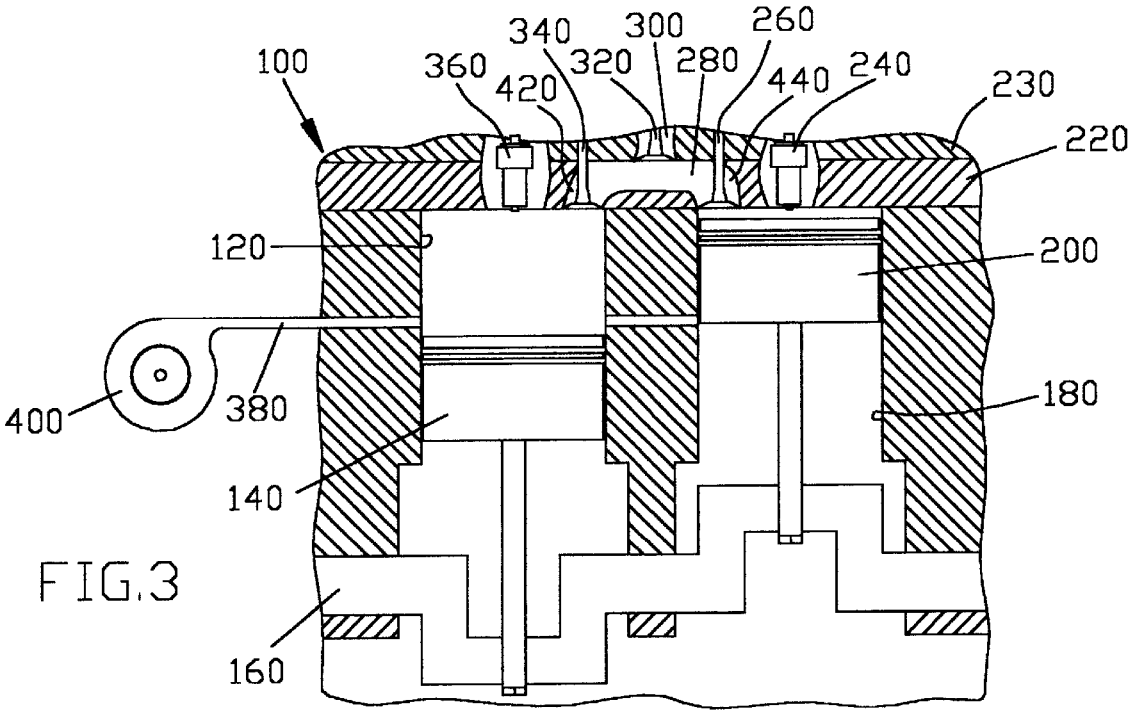
FIG. 3 is a schematic view, partly in cross-section, of a fuel injected two-stroke internal combustion engine with auto-ignition, in accordance with a preferred embodiment of this invention.

In contrast, operation of a two-stroke engine differs enough to warrant further discussion. A two-stroke diesel engine 100 is illustrated in FIG. 3 to highlight the operational differences. The descriptions and functions of the components of the present invention are generally applicable to both four and two-stroke engines. Though many forms of two-stroke engines provide intake and exhaust ports in the side-wall of the combustion cylinder, the following will be described in terms of a construction very similar to the above for reasons of clarity.

In operation of the two-stroke diesel engine 100 FIG. 3, and in valve timing diagram FIG. 4. The example illustrated in FIG. 4 is only a representation of valve timing, which is adapted for purposes of clarity in practicing the present invention. Those skilled in the art will be readily adept to the teachings of the present invention to engines having a different number of cycles and timing sequences.

Air is forced by a blower 400 into combustion exhaust cylinder 120 through intake port 380, for approximately 0–30 degrees crankshaft rotation during the first intake compression stroke (4A) of the combustion exhaust piston 140. The air is subsequently compressed within the combustion exhaust cylinder 120, for approximately 30–150 degrees crankshaft rotation during the first intake compression stroke (4B) of combustion exhaust piston 140.

A first combustible fuel is injected just prior to TDC by fuel injector 360, the fuel auto-ignites and drives piston 140 down toward BDC from approximately 150–330 degrees during the first power-exhaust stroke (4C), of combustion exhaust piston 140.

Exhaust port 420 and exhaust port 440 are opened by exhaust valves 340 and 260 preferably located in cylinder head 220. As exhaust gasses exit, intake port 380 is again opened by combustion exhaust piston 140 allowing air to enter for 330–360 degrees during the first power-exhaust stroke (4D) of combustion exhaust piston 140, during the first revolution of crankshaft 16. Air continues to be forced in form 0–30 degrees (4E) and exhaust port 420 and 440 remain opened by exhaust valve 340 and 260. The combustion gasses exit through port 420 into fluidic passage 280 for approximately 0–150 degrees crankshaft rotation during the first intake-exhaust stroke(4F) of the combustion exhaust piston 140.

Exhaust gasses received by combustion cylinder 180 through exhaust port 440 at the start of the second intake power-exhaust stroke (4S) of combustion exhaust piston 200 to produce usable work from the incompletely expanded exhaust gasses of combustion exhaust cylinder 120. From there spent combustion exhaust gases exhaust to atmosphere for 150–180 degrees crankshaft rotation, through exhaust port 34 preferably located in cylinder head 230 during the second intake power-exhaust stroke (4T) of combustion exhaust piston 200.

Exhaust port 420 and exhaust port 300 remain open by exhaust valve 340 and exhaust valve 320 from 150–330 degrees during the first intake stroke (4G) of combustion exhaust piston 140. Intake port 380 is opened by combustion exhaust piston 140 from 330–360, which allows air to enter during the first intake stroke (4H), during the second revolution of crankshaft 160.

Air continues to be forced into combustion exhaust cylinder 140 for approximately 0–30 degrees crankshaft rotation during the second intake-compression stroke (4J) of the combustion exhaust piston 140. The air is subsequently compressed within the combustion exhaust cylinder 120, for approximately 30–150 degrees crankshaft rotation during the second intake-compression stroke (4K) of combustion exhaust piston 140.

Exhaust gasses received by combustion cylinder 120 through exhaust port 420 from combustion exhaust cylinder 180, at the start of the first intake power-exhaust stroke (4L) of combustion exhaust piston 140. Combustion exhaust piston 140 is forced downward by the incompletely expanded exhaust gasses from combustion cylinder 180 for approximately 150–330 degrees crankshaft rotation. Exhaust port 420 and exhaust port 440 remain open and exhaust port 300 is opened by exhaust valve 320. Intake 380 is opened by piston 140 as spent gasses are exhausted to atmosphere for 330–360 degrees crankshaft rotation during the first intake power-exhaust stroke (4M), during the third revolution of crankshaft 160, which completes one cycle of combustion exhaust cylinder 120.

Combustion exhaust cylinder 180 also cycles through three revolutions of crankshaft rotation 160, the same as combustion cylinder 120 by the aforementioned 30 to 180 degree crankshaft angle lead and timed such that during the first intake compression stroke (4A) of combustion exhaust cylinder 120, combustion exhaust cylinder 180 is beginning a second intake stroke (4N).

Exhaust port 440 and exhaust ports 300 are opened by exhaust valve 260 and exhaust valve 320, for 0–150 degrees during the second intake stroke (4N) of combustion exhaust piston 200. Intake port 380 is opened by combustion exhaust piston 200 from 150–180 degrees which allows air to be forced into combustion exhaust cylinder 180 for approximately 150–210 degrees crankshaft rotation during the third intake-compression stroke (4Q) of the combustion exhaust piston 200. The air is subsequently compressed within the combustion exhaust cylinder 180, for approximately 210–360 degrees crankshaft rotation during the third intake-compression stroke (4R) of combustion exhaust piston 200 during the first revolution of crankshaft 160.

Exhaust gasses are received by combustion exhaust cylinder 180 through exhaust port 440 from combustion exhaust cylinder 120, at the start of the second intake power-exhaust stroke (4S) of combustion exhaust piston 200.

Combustion exhaust piston 200 is forced downward by the incompletely expanded exhaust gasses from combustion cylinder 120 for approximately 0–150 degrees crankshaft rotation. Exhaust port 440 exhaust port 300 and exhaust port 420 and intake port 380 are opened by exhaust valve 260 exhaust valve 320 and exhaust valve 340 and piston 200. Spent gasses are exhausted to atmosphere as fresh air enters for 150–180 degrees crankshaft rotation during second intake power-exhaust stroke (4T).

Air continues to enter via blower 400 into combustion exhaust cylinder 180 through intake port 380, for approximately 180–210 degrees crankshaft rotation during the fourth intake-compression stroke (4U) of the combustion exhaust piston 200. The air is subsequently compressed within the combustion exhaust cylinder 180, for approximately 210–360 degrees crankshaft rotation during the fourth intake-compression stroke (4V) of combustion exhaust piston 200.

A second combustible fuel is injected just prior to TDC by fuel injector 240, the fuel auto-ignites and drives piston 200 down toward BDC from 0–150 degrees during the second power-exhaust stroke (4W), of combustion exhaust piston 200. Exhaust port 440 and exhaust port 420 are opened by exhaust valves 260 and 340. As exhaust gasses exit, intake port 380 is again opened by combustion exhaust piston 200 allowing air to enter for 150–180 degrees during the second power-exhaust stroke (4X) of combustion exhaust piston 200. Exhaust port 440 and 420 remain opened by exhaust valve 260 and 340. As combustion gasses exit through port 440 into fluidic passage 280 air continues to enter through intake port 380 for approximately 180–210 degrees crankshaft rotation during the second intake exhaust stroke (4Y) of the combustion exhaust piston 200.

Exhaust gasses received by combustion cylinder 120 through exhaust port 420 at the start of the first intake power-exhaust stroke (4L) of combustion exhaust piston 140.

For 150–330 degrees crankshaft rotation. Fresh air is admitted as spent gasses are exhausted to atmosphere for 330–360 degrees crankshaft rotation during the first intake power-exhaust stroke (4M)(4Z). Usable work is obtained from the incompletely expanded exhaust gasses of combustion exhaust cylinder 180, for 150–330 degrees crankshaft rotation during the third revolution of crankshaft 160 which makes one complete cycle of combustion exhaust cylinder 180 and from here the above mentioned cycle repeats.

Figure 5:
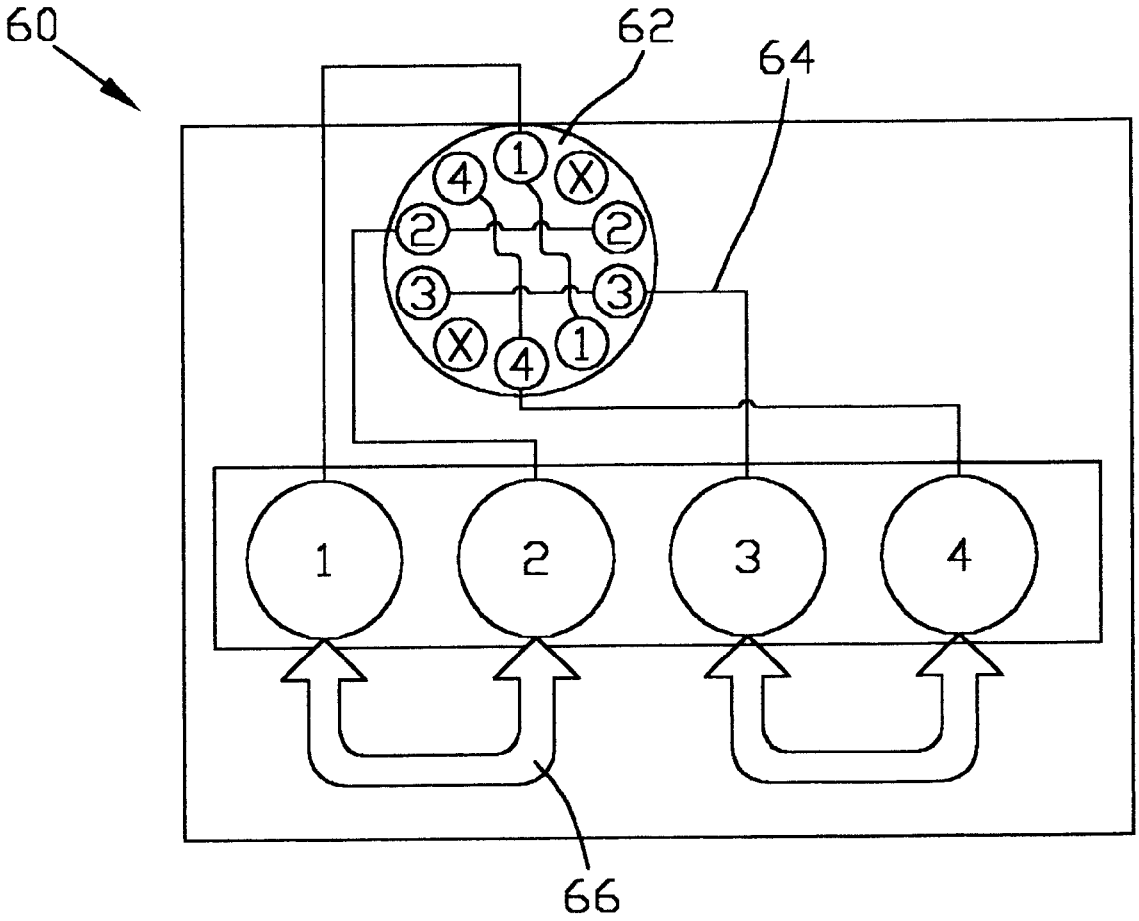
FIG. 5 is a schematic representation of a preferred firing order for a four-cylinder internal combustion engine in accordance with a preferred embodiment of this invention.

FIG. 5 is a schematic representation of a 4-cylinder inline internal combustion engine 60, which has been modified to incorporate the teachings of the present invention. For illustrative purposes a stock 4-cylinder engine has a firing order of 1-4-2-3-X-4-1-3-2-X as (X shows no connection) as indicated by the engine distributor 62. The distributor wiring 64 electrically connects the distributor 62 to the combustion exhaust cylinders 1,4,2 and 3. FIG. 5 also shows the combustion exhaust cylinders as each being in communication with their corresponding combustion exhaust cylinders via corresponding fluidic passages 66. Combustion exhaust cylinder 1 is in communication with combustion exhaust cylinder 2. Combustion exhaust cylinder 3 is in communication with combustion exhaust cylinder 4.

As will be readily apparent to one skilled in the art. The example illustrated in FIG. 5. Is only a representation of a firing order, which is adapted for purposes of practicing the present invention. Those skilled in the art will be readily adapt the teachings of the present invention to engines having a different number of cylinders and various firing orders.

A significant advantage of the preferred embodiment is that the combustion exhaust gases of the first cylinder and the combustion exhaust gases of the second cylinder are not merely exhausted to atmosphere, but are used to directly derive additional work form the engine in a preferred operating cycle.

As a result the output torque of an IC engine in accordance with the preferred embodiment is greater than that of a comparably sized IC engine having the same number of cylinders burning the same quantity of fuel.

While the invention has been described in terms of a preferred embodiment, it is apparent that one skilled in the art could adapt other forms. Examples are relocating the intake and exhaust ports of the cylinder heads for improved gas dynamics. Modifying the fluidic passage to enhance flow characteristics. Accordingly, the scope of the invention is to be limited only by the following claims.

What is claimed is:

1. A two-stroke type internal combustion reciprocating piston engine (100) comprising:

(a) a first cylinder (120);

(b) a first piston (140) reciprocally residing within said first cylinder (120), said first cylinder piston (140), being reciprocated by first reciprocating means;

(c) a first cylinder intake port (380) associated with said first cylinder (120), said first cylinder intake port (380) being opened by said first cylinder piston (140) associated therewith, said first cylinder intake port (380) being open for intake approximately 30 degrees of crankshaft rotation during, a first intake-compression stroke (4A), a first power-exhaust stroke (4D), a first intake-exhaust stroke (4E), a first intake stroke (4H), a second intake-compression stroke (4J)and a first intake power-exhaust stroke (4M);

(d) said first cylinder intake port (380) associated with said first cylinder (120), said first cylinder intake port (380) being closeable by said first cylinder piston (140) associated therewith, said first cylinder intake port (380) being closed for intake approximately 150 degrees of crankshaft rotation during, said first intake-compression stroke (4B), said first power-exhaust stroke (4C), said first intake-exhaust stroke (4F), said first intake stroke (4G), said second intake-compression stroke (4K) and said first intake power-exhaust stroke (4L);

(e) a first cylinder exhaust port (420) associated with said first cylinder (120), said first cylinder exhaust port (420) being opened with a first cylinder exhaust valve (340), by operation of a first camming means associated therewith, said first cylinder exhaust port (420), being opened by said first cylinder exhaust valve (340), for exhaust approximately 30 degrees of crankshaft rotation, during said first power exhaust stroke (4D), and approximately 180 degrees crankshaft rotation, during said first intake-exhaust stroke (4E)(4F), said first intake stroke (4G)(4H), and said first intake power-exhaust stroke (4L)(4M), of said first cylinder piston (140);

(f) said first cylinder exhaust port (420) associated with said first cylinder (120), said first cylinder exhaust port (420) being closeable with said first cylinder exhaust valve (340) associated therewith, said first cylinder exhaust port (420), being closed by said first cylinder exhaust valve (340), for exhaust approximately 180 degrees of crankshaft rotation, during said first intake-compression stroke (4A)(4B), said second intake-compression stroke (4J)(4K), and said first power exhaust stroke (4C);

(g) a second cylinder (180) in communication with said first cylinder (120);

(h) a second piston (200) reciprocally residing within said second cylinder (180), said second cylinder piston (200) being reciprocated by a second reciprocating means, said second cylinder piston (200) leading said first cylinder piston (140) by a predetermined phase angle approximately 0–180 degrees such that said second cylinder piston (200), is retreating from top dead center when said first cylinder piston (140) is retreating from bottom dead center;

(i) a second cylinder intake port (380) associated with said second cylinder (180), said second cylinder intake port (380) being opened by said second cylinder piston (200) associated therewith, said second cylinder intake port (380) being open for intake, approximately 30 degrees of crankshaft rotation during, a second intake stroke (4P), a third intake-compression stroke (4Q), a second intake power-exhaust stroke (4T), a fourth intake compression stroke (4U) a second power exhaust stroke (4X), and a second intake-exhaust stroke (4Y);

(j) said second cylinder intake port (380) associated with said second cylinder (180), said second cylinder intake port (380), being closeable by said second cylinder piston (200) associated therewith, said second cylinder intake port (380), being closed for intake approximately 150 degrees of crankshaft rotation during, said second intake stroke (4N), said third intake-compression stroke (4R), said second intake power-exhaust stroke (4S), said fourth intake-compression stroke (4V), said second power-exhaust stroke (4W), and said second intake-exhaust stroke (4Z);

(k) a second cylinder exhaust port (440) associated with said second cylinder (180), said second cylinder exhaust port (440), being opened with a second cylinder exhaust valve (260), by operation of a second camming means associated therewith, said second cylinder exhaust port (440), being opened by said second cylinder exhaust valve (260), for exhaust approximately 30 degrees of crankshaft rotation, during, said second power-exhaust stroke (4X) and approximately 180 degrees of crankshaft rotation during, said second intake stroke (4N)(4P), said second intake power exhaust stroke (4S)(4T), and said second intake-exhaust stroke (4Y)(4Z) of said second cylinder piston (200);

(l) said second cylinder exhaust port (440) associated with said second cylinder, said second cylinder exhaust port (440), being closeable with said second cylinder exhaust valve (260) associated therewith, said second cylinder exhaust port (440), being closed by said second cylinder exhaust valve (260), for exhaust approximately 150 degrees of crankshaft rotation, during said third intake-compression stroke (4Q) (4R), said fourth intake-compression stroke (4U)(4V) and said second power-exhaust stroke (4W);

(m) a fluidic communication means (280), between said first exhaust port (420) and said second exhaust port (440);

(n) a third exhaust port (300) associated with said first cylinder (120) and in fluidic communication with said first cylinder exhaust port (420), said third exhaust port (300), being closeable with a third exhaust valve (320), by operation of a third camming means associated therewith, said third exhaust port being closed by said third exhaust valve (320), for exhaust approximately 180 degrees of crankshaft rotation, during said first intake-compression stroke (4A)(4B), said first power-exhaust stroke (4C)(4D), said first intake-exhaust stroke (4E)(4F), said second intake-compression stroke (4J)(4K) and said first intake power-exhaust stroke (4L), said third exhaust port (300) being opened by said third exhaust valve (320), for exhaust approximately 180 degrees of crankshaft rotation, during said first intake stroke (4G)(4H), and approximately 30 degrees of crankshaft rotation, during, said first intake power-exhaust stroke (4M) of said first cylinder piston (140);

(o) said third exhaust port (300) associated with said second cylinder (180), and in fluidic communication with said second cylinder exhaust port (440), said third exhaust port (300), being closeable with said third exhaust valve (320) associated therewith, said third exhaust port (300), being closed by said third exhaust valve (320), for exhaust approximately 180 degrees of crankshaft rotation, during said third intake-compression stroke (4Q)(4R), said second intake power-exhaust stroke (4S), said fourth intake-compression stroke (4U)(4V), said second power-exhaust stroke (4W)(4X), and said second intake-exhaust stroke (4Y)(4Z), said third exhaust port (300) being opened by said third exhaust valve (320), for exhaust approximately 180 degrees of crankshaft rotation, during said second intake stroke (4N)(4P), and approximately 30 degrees of crankshaft rotation, during said second intake power-exhaust stroke (4T), of said second cylinder piston (200);

(p) said fluidic communication means (280), between said first cylinder exhaust port (420), said second cylinder exhaust port (440) and said third exhaust port (300);

(q) a first fuel supply means (360), to provide a first combustible fuel to said first cylinder (120), said first combustible fuel being introduced into said first cylinder (120) during said first intake compression stroke (4B), said first combustible fuel producing first combustion gasses within said first cylinder (120) during combustion of said first combustible fuel during said first power-exhaust stroke (4C), said first combustion gasses being expelled from said first cylinder (120) during said first power-exhaust stroke (4D) and said first intake-exhaust stroke (4E)(4F), said first combustion exhaust gasses flowing to said second cylinder (180) via said first cylinder exhaust port (420), said first combustion exhaust gasses being received by said second cylinder (180) via said second cylinder exhaust port (440), during said second intake power-exhaust stroke (4S), said first combustion exhaust gasses being expelled from said second cylinder via said third exhaust port (300) during said second intake power-exhaust stroke (4T);

(r) a second fuel supply means (240) to provide a second combustible fuel to said second cylinder (180), said second combustible fuel being introduced into said second cylinder (180) during said fourth intake-compression stroke (4U), said second combustible fuel producing second combustion gasses within said second cylinder (180), during combustion of said second combustible fuel during said second power-exhaust stroke (4W), said second combustion gasses being expelled from said second cylinder (180), during said second power-exhaust stroke (4X), and said second intake-exhaust stroke (4Y)(4Z), second combustion exhaust gasses flowing to said first cylinder (120), via said second cylinder exhaust port (440), said second combustion exhaust gasses being received by said first cylinder (120), via said first cylinder exhaust port (420) during said first intake power-exhaust stroke (4L), said second combustion exhaust gasses being expelled from said first cylinder (120), via said third exhaust port (300) during said first intake power-exhaust stroke (4M).

2. An internal combustion engine (100) as defined in claim 1, further comprising:

(a) said first fuel admission means (360) associated with said first cylinder (120), for admitting said first combustible fuel;

(b) a first ignition means associated with said first cylinder (120), for igniting said first combustible fuel to produce combustion gasses;

(c) said second fuel admission means (240) associated with said second cylinder (180), for admitting said second combustible fuel;

(d) a second ignition means associated with said second cylinder (180), for igniting said second combustible fuel to produce combustion gasses.

3. An internal combustion engine (100) as defined in claim 1, wherein:

(a) said third exhaust port (300) is closed by said third exhaust valve (320), during said first intake power-exhaust stroke (4L) of said first cylinder piston (120);

(b) said third exhaust port (300) is closed by said third exhaust valve (320), during said second intake power-exhaust stroke (4S) of said second cylinder piston (180).

4. An internal combustion engine (100) as defined in claim 3, wherein:

(a) said third exhaust port (300) is opened by said third exhaust valve (320), during said first intake stroke (4G) of said first cylinder piston (140);

(b) said third exhaust port (300) is open by said third exhaust valve (320), during said second intake stroke (4N) of said second cylinder piston (200).

5. An internal combustion engine as defined in claim 4, wherein:

(a) said third exhaust port (300) is opened by said third exhaust valve (320), during said first intake power-exhaust stroke (4M) of said first cylinder piston (140);

(b) said third exhaust port (300) is opened by said third exhaust valve (320), during said second intake power-exhaust stroke (4T) of said second cylinder piston (200).

6. An internal combustion engine as defined in claim 1, wherein:

(a) said first cylinder intake port (380) is closed by said first cylinder piston (140) during said first intake-compression stroke (4B) of said first cylinder piston (140);

(b) said first cylinder exhaust port (420) is closed by said first cylinder exhaust valve (340), during said first intake-compression stroke (4B), of said first cylinder piston (140);

(c) said first combustible fuel is compressed within said first cylinder (120), during said first intake-compression stroke (4B), of said first cylinder piston (140);

(d) said second cylinder intake port (380) is closed by said second cylinder piston (200), during said fourth intake-compression stroke (4V), of said second cylinder piston (200);

(e) said second cylinder exhaust port (420) is closed by said second cylinder exhaust valve (260), during said fourth intake-compression stroke (4V), of said second cylinder piston (200);

(f) said second combustible fuel is compressed within said second cylinder during, said fourth intake-compression stroke (4V), of said second cylinder piston;

(g) said first cylinder intake port (380) is closed by said first cylinder piston (140), during said second intake-compression stroke (4K), of said first cylinder piston (140);

(h) said first cylinder exhaust port (420) is closed by said first cylinder exhaust valve (340), during said second intake-compression stroke (4K), of said first cylinder piston (140);

(i) said second cylinder intake port (380) is closed by said second cylinder piston (200), during said third intake-compression stroke (4R), of said second cylinder piston (200);

(j) said second cylinder exhaust port (420) is closed by said second cylinder exhaust valve (260), during said third intake-compression stroke (4R), of said second cylinder piston (200).

7. An internal combustion engine (100), as defined in claim 6, wherein:

(a) said first cylinder intake port (380) is closed by said first cylinder piston (140), during said first power-exhaust stroke (4C), of said first cylinder piston (140);

(b) said first cylinder exhaust port (420) is closed by said first cylinder exhaust valve (340), during said first power-exhaust stroke (4C), of said first cylinder piston (140);

(c) said first combustible fuel mixture combusting within said first cylinder (120), during said first power-exhaust stroke (4C), of said first cylinder piston (140);

(d) said second cylinder intake port (380) is closed by said second cylinder piston (200), during said second power-exhaust stroke (4W), of said second cylinder piston (200);

(e) said second cylinder exhaust port (380) is closed by said second cylinder exhaust valve (340), during said second power-exhaust stroke (4W), of said second cylinder piston (200);

(f) said second combustible fuel mixture combusting within said second cylinder (180), during said second power-exhaust stroke (4W), of said second cylinder piston (200).

8. An internal combustion engine as defined in claim 7, wherein:

(a) said first cylinder intake port (380) is open by said first cylinder piston (140), during said first intake exhaust stroke (4E), of said first cylinder piston;

(b) said second cylinder intake port (380) is open by said second cylinder piston (200), during said second intake-exhaust stroke (4Y), of said second cylinder piston (200);

(c) said first cylinder intake port (380) is open by said first cylinder piston (140), during said first intake power-exhaust stroke (4M), of said first cylinder piston (140);

(d) said second cylinder intake port (380) is open by said second cylinder piston (200), during said second intake power-exhaust stroke (4T), of said second cylinder piston (200).

9. An internal combustion engine (100), as defined in claim 8, wherein:

(a) said first combustion exhaust gases exert a force upon said first cylinder piston (140), during said first intake power-exhaust stroke (4L), of said first cylinder piston (140);

(b) said second combustion exhaust gases exert a force upon said second cylinder piston (200), during said second intake power-exhaust stroke (4S), of said second cylinder piston (200).

10. A four-stroke type internal combustion reciprocating piston engine (10) comprising:

(a) a first cylinder (12), said first cylinder (12) having a first ignition means (40) associated therewith;

(b) a first cylinder piston (14) reciprocally residing within said first cylinder (12), said first cylinder piston (14), being reciprocated by a first reciprocating means, said first cylinder piston (14), successively having a first intake stroke (2A), a first compression stroke (2B), a first power stroke (2C), a first exhaust stroke (2D), a second intake stroke (2E), a second compression stroke (2F), a second power stroke (2G), a second exhaust stroke (2H), a first intake power stroke (2J), and a third exhaust stroke (2K);

(c) a first intake port (44), located in said first cylinder (12);

(d) a first intake valve (42) operatively associated with said first intake port (44), said first intake valve (42) being capable of closing said first intake port (44) by operation of a first camming means in communication therewith, said first intake port (44), being opened by said first intake valve (42) during said first intake stroke (2A) and said second intake stroke (2E) of said first cylinder piston (14), said first intake port (44), being closed by said first intake valve (42), during said first compression stroke (2B), said first power stroke (2C), said first exhaust stroke (2D), said second compression stroke (2F), said second power stroke (2G), said second exhaust stroke (2H), said first intake power stroke (2J), and said third exhaust stroke (2K), of said first cylinder piston (14);

(e) a first exhaust port (50), located in said first cylinder (12);

(f) a first exhaust valve (38) operatively associated with said first exhaust port (50), said first exhaust valve (38), being capable of closing said first exhaust port (50), by operation of a second camming means in communication therewith, said first exhaust port (50), being opened by said first exhaust valve (38), during said first exhaust stroke (2D), said second exhaust stroke (2H), and said third exhaust stroke (2K), of said first cylinder piston (14), said first exhaust port (50), being closed by said first exhaust valve (38), during said first intake stroke (2A), said first compression stroke (2B), said first power stroke (2C), said second intake stroke (2E), said second compression stroke (2F), and said second power stroke (2G), and said first intake power stroke (2J), of said first cylinder piston (14);

(g) a second cylinder (18), having a second ignition means (28) associated therewith;

(h) said second cylinder (18), in communication with said first cylinder (12);

(i) said second cylinder piston (20) reciprocally residing within said second cylinder (18), said second piston (20), being reciprocated by a second reciprocating means, said second cylinder piston (20), successively having a third compression stroke (2L), a third power stroke (2M), a fourth exhaust stroke (2N), a second intake power stroke (2P), a fifth exhaust stroke (2Q), a third intake stroke (2R), a fourth compression stroke (2S), a fourth power stroke (2T), a sixth exhaust stroke (2U) and a fourth intake stroke (2V);

(j) a second intake port (24) located in said second cylinder (18);

(k) a second intake valve (26) operatively associated with said second intake port (24), said second intake valve (26), being capable of closing said second intake port (24), by operation of a third camming means in communication therewith, said second intake port (24) being opened by said second intake valve (26) during said third intake stroke (2R), and said fourth intake stroke (2V) of said second cylinder piston (20), said second intake port (24) being closed by said second intake valve (26) during said third compression stroke (2L), said third power stroke (2M), said fourth exhaust stroke (2N), said second intake power stroke (2P), a fifth exhaust stroke (2Q), a fourth compression stroke (2S), a fourth power stroke (2T) and said sixth exhaust stroke (2U), of said second cylinder piston (20);

(l) a second exhaust port (52) located in said second cylinder (18);

(m) a second exhaust valve (30) operatively associated with said second exhaust port (52), said second exhaust valve (30), being capable of closing said second exhaust port (52), by operation of a fourth camming means in communication therewith, said second exhaust port (52) being opened by said second exhaust valve (30), during said fourth exhaust stroke (2N), said second intake power exhaust stroke (2P), said fifth exhaust stroke (2Q) and said sixth exhaust stroke (2U), of said second cylinder piston (20), said second exhaust port (52) being closed by said second exhaust valve (30), during said third compression stroke (2L), said third power stroke (2M), said third intake stroke (2R), said fourth compression stroke (2S), and said fourth power stroke (2T), said fourth intake stroke (2V), of said second cylinder piston (20);

(n) a third exhaust port (34) loacated in a second cylinder head 48 in fluidic communication with said first exhaust port (50), and said second exhaust port (52);

(o) a third exhaust valve (36) operatively associated with said third exhaust port (34), said third exhaust valve

(36) being capable of opening said third exhaust port (34), by operation of a fifth camming means in communication therewith, said third exhaust port (34) being opened by said third exhaust valve (36), during said second exhaust stroke (2H), said third exhaust stroke (2K), of said first cylinder piston (14);

(p) said third exhaust valve (36) operatively associated with said third exhaust port (34), said third exhaust valve (36), being capable of opening said third exhaust port (34), during said fourth exhaust stroke (2N) and said fifth exhaust stroke (2Q), of said second cylinder piston (20);

(q) said third exhaust valve (36) operatively associated with said third exhaust port (34), said third exhaust valve being capable of closing said third exhaust port (34), during said first intake power stroke (2J) of said first cylinder piston (14);

(r) said third exhaust valve (36) operatively associated with said third exhaust port (34), said third exhaust valve (36), being capable of closing said third exhaust port (34), during said second intake power stroke (2P) of said second cylinder piston (20);

(s) a fluidic communication means (32) between said first cylinder exhaust port (50), said second cylinder exhaust port (52) and said third exhaust port (34).

11. An internal combustion reciprocating piston engine (10) as defined in claim 10 further comprising:

(a) a fuel supply means (46) to provide a first combustible fuel to said first cylinder (12) through said first intake port (44), said first combustible fuel being introduced into said first cylinder (12) during said first intake stroke (2A);

(b) said first combustible fuel being compressed within said first cylinder (12), during said first compression stroke (2B);

(c) said first combustible fuel producing first combustion gases within said first cylinder (12) upon ignition of said first combustible fuel mixture by a first ignition means (40), during said first power stroke (2C), said first combustion gases being expelled from said first cylinder during said first exhaust stroke (2D);

(d) said first combustion exhaust gases flowing to said second cylinder (18) via said first exhaust port (50), fluidic communication means (32), between said first cylinder exhaust port (50) and said second exhaust cylinder exhaust port (52);

(e) said first combustion exhaust gases being received by said second cylinder (18) via said second exhaust port (52), during said second intake power stroke (2P), said first combustion exhaust gases being expelled from said second cylinder (18), via said third exhaust port (34) during said fifth exhaust stroke (2Q), of said second cylinder piston (20);

(f) said fuel supply means (46) to provide a second combustible fuel to said first cylinder (12) through said first intake port (44), said second combustible fuel being introduced into said first cylinder (12) during said second intake stroke (2E);

(g) said second combustible fuel being compressed within said first cylinder (12), during said second compression stroke (2F);

(h) said second combustible fuel producing second combustion gases within said first cylinder (12), during second combustion of said second combustible fuel during said second power stroke (2G);

(i) said second combustion gases being expelled from said first cylinder (12), during said second exhaust stroke (2H), of said first cylinder piston (14);

(j) said fuel supply means (46) to provide a third combustible fuel to said second cylinder (18) through said second intake port (24), said third combustible fuel being introduced into said second cylinder (18) during said third intake stroke (2R);

(k) said third combustible fuel being compressed within said second cylinder (18) during said fourth compression stroke (2S);

(l) said third combustible fuel producing third combustion gases within said second cylinder (18) during third combustion of said third combustible fuel during said fourth power stroke (2T);

(m) said third combustion gases being expelled from a second cylinder (18) during a sixth exhaust stroke (2U), said third combustion exhaust gases flowing to said first cylinder (12) via said second exhaust port (52);

(n) said third combustion exhaust gases being received by said first cylinder (12), via said first exhaust port (50) during said first intake power stroke (2J);

(o) said third combustion exhaust gasses being expelled from a first cylinder (12), via said third exhaust port (34) during said third exhaust stroke (2K);

(p) said fuel supply means (46) to provide a fourth combustible fuel to said second cylinder (18), through said second intake port (24), said fourth combustible fuel being introduced into said second cylinder (18) during said fourth intake stroke (2V);

(q) said fourth combustible fuel being compressed within said second cylinder (18), during said third compression stroke (2L);

(r) said fourth combustible fuel producing fourth combustion gases within said second cylinder (18), during said fourth combustion of said fourth combustible fuel during said third power stroke (2M);

(s) said fourth combustion exhaust gasses being expelled from said second cylinder (18), during said fourth exhaust stroke (2N).

12. An internal combustion reciprocating piston engine (10) as defined in claim 11:

(a) said first combustion exhaust gases exert a force upon said second cylinder piston (20), during said second intake power stroke (2P) of said second cylinder piston (20);

(b) said third combustion exhaust gases exert a force upon said first cylinder piston (14), during said first intake power stroke (2J) of said first cylinder piston (14).

13. An internal combustion reciprocating piston engine (10) as defined in claim 10:

(a) a method of driving work from said first combustion exhaust gases expelled by said first cylinder piston (14), reciprocally residing within said first cylinder (12), and said third combustion exhaust gases expelled by said second cylinder piston (20), reciprocally residing within said second cylinder (18), by diverting said first combustion exhaust gases of said first cylinder piston (14), to said second cylinder (18) having a second cylinder piston (20), reciprocally residing therein, and diverting said third combustion exhaust gases of said second cylinder piston (20), to said first cylinder (12) having a first cylinder piston (14), reciprocally residing therein, in a predetermined cycle in an IC engine; a method comprising the steps of:

(b) providing said first combustible fuel mixture to said first cylinder (12), during said first intake stroke (2A) of said first cylinder piston (14);

(c) combusting said first combustible fuel mixture to produce said first combustion gases;

(d) expelling said first combustion exhaust gases from said first cylinder piston (14) to said second cylinder piston (18), to exert said force on said second cylinder piston (20), during said first exhaust stroke (2D) of said first cylinder piston (14) and said second intake power stroke (2P), of said second cylinder piston (20) and, (e) expelling said first combustion exhaust gases from said second cylinder (18), during said fifth exhaust stroke (2Q) of said second cylinder piston (20);

(f) providing a second combustible fuel mixture to said first cylinder (12), during said second intake stroke (2E) of said first piston (14);

(g) combusting said second combustible fuel mixture to produce said second combustion gases during said second power stroke (2G) of said first cylinder piston (14);

(h) expelling said second combustion exhaust gases from said first cylinder (12) during a second exhaust stroke (2H) of said first cylinder piston (12);

(i) providing said third combustible fuel mixture to said second cylinder (18), during said third intake stroke (2R) of said second piston (20);

(j) combusting said third combustible fuel mixture to produce said third combustion gases;

(k) expelling said third combustion exhaust gases from said second cylinder (18), to said first cylinder (12), to exert said force on said first cylinder piston (14), during the said sixth exhaust stroke (2V) of said second cylinder piston (20), during said first intake power stroke (2J) of said first cylinder piston (14) and, (l) expelling said third combustion exhaust gases from said first cylinder (12), during said third exhaust stroke (2K) of said first cylinder piston (14);

(m) providing said fourth combustible fuel mixture to said second cylinder (18), during said fourth intake stroke (2V) of said second piston (20);

(n) combusting said fourth combustible fuel mixture to produce said fourth combustion gases during said third power stroke (2M) of said second cylinder piston (20);

(o) expelling said fourth combustion gases from said second cylinder (18), during said fourth exhaust stroke (2N) of said second cylinder piston (20).

14. A method as defined in claim 13, further comprising the additional steps of:

(a) compressing said first combustible fuel mixture within said first cylinder (12), during said first compression stroke (2B) of said first cylinder piston (14);

(b) compressing said second combustible fuel mixture within said first cylinder (12), during said second compression stroke (2F), of said first cylinder piston (14);

(c) combusting said first combustible fuel mixture to produce said first combustion gases so as to promote said first power stroke (2C) of said first cylinder piston (14), and to produce said first combustion exhaust gases so as to promote said second intake power stroke (2P), of said second cylinder piston (20);

(d) combusting said second combustible fuel mixture to produce said second combustion gases so as to promote said second power stroke (2G), of said first cylinder piston (14);

(e) compressing said third combustible fuel mixture within said second cylinder (18) during said fourth compression stroke (2S) of said second cylinder piston (20);

(f) compressing said fourth combustible fuel mixture within said second cylinder (18), during said third compression stroke (2L) of said second cylinder piston (20);

(g) combusting said third combustible fuel mixture to produce said third combustion gases so as to promote said fourth power stroke (2T), of said second cylinder piston (20), and to produce said third combustion exhaust gases so as to promote said first intake power stroke (2J) of said first cylinder piston (14);

(h) combusting said fourth combustible fuel mixture to produce said fourth combustion gases so as to promote said third power stroke (2M) of said second cylinder piston (20).

15. A method as defined in claim 14, further comprising the additional steps of:

(a) combusting said combustible fuel mixture to produce said first power stroke of said first cylinder piston (14), receiving said combustion exhaust gases to produce said first intake power stroke of said first cylinder piston (14);

(b) combusting said combustible fuel mixture to produce said first power stroke, of said second cylinder piston (20), receiving said combustion exhaust gases to produce said first intake power stroke, of said second cylinder piston (20).

* * * * *